United States Patent [19]

Wotowiec

[11] 4,208,702

[45] Jun. 17, 1980

[54] MOUNTING MEANS FOR LAMP FIXTURE

[75] Inventor: Joseph P. Wotowiec, Cuyahoga Falls, Ohio

[73] Assignee: General Electric Company, Schenectady, N.Y.

[21] Appl. No.: 956,862

[22] Filed: Nov. 1, 1978

[51] Int. Cl.[2] ..... F21V 21/00; F21V 21/08; F21S 3/02; H01R 33/08

[52] U.S. Cl. ..... 362/217; 248/205 R; 248/314; 248/342; 248/343; 339/37; 339/44 R; 339/50 R; 339/119 L; 339/125 L; 339/135; 362/220; 362/225; 362/226; 362/260; 362/370; 362/382; 362/389; 362/404; 362/432; 362/457

[58] Field of Search ..... 362/217, 220, 223–226, 362/249, 260, 368, 370, 382, 388, 389, 404, 430, 432, 457; 339/37, 44 R, 44 M, 50 C, 50 R, 125 R, 125 L, 135, 119 R, 119 L; 248/342, 343, 205 R, 314

[56] References Cited

U.S. PATENT DOCUMENTS

| | | | |
|---|---|---|---|
| 2,182,434 | 12/1939 | Hohl | 362/217 |
| 2,339,751 | 1/1944 | Beal | 362/382 |
| 2,393,062 | 1/1946 | Reeves | 362/217 |
| 2,513,832 | 7/1950 | Weisberg | 362/217 |
| 2,958,763 | 11/1960 | Bodian | 339/50 R |
| 3,065,343 | 11/1962 | Zurawski | 362/217 |
| 3,285,560 | 11/1966 | Pistey | 362/217 |
| 3,297,977 | 1/1967 | Smith | 339/50 R |
| 3,436,716 | 4/1969 | Amis, Jr. et al. | 362/217 |
| 3,974,418 | 8/1976 | Fridrich | 362/218 |
| 4,092,562 | 5/1978 | Campbell | 362/221 |

FOREIGN PATENT DOCUMENTS

| | | | |
|---|---|---|---|
| 269901 | 3/1965 | Australia | 362/217 |
| 259071 | 12/1967 | Austria | 362/217 |
| 475030 | 7/1951 | Canada | 339/125 L |
| 462831 | 4/1951 | Italy | 362/217 |
| 655773 | 7/1963 | Italy | 362/217 |
| 1027189 | 4/1966 | United Kingdom | 362/217 |

*Primary Examiner*—Teddy S. Gron
*Attorney, Agent, or Firm*—Norman C. Fulmer; Lawrence R. Kempton; Philip L. Schlamp

[57] ABSTRACT

A fluorescent lamp fixture having mounting brackets provided with keyhole-shaped openings for accommodating mounting screws. The mounting brackets have cover flaps for concealing the screws, and the flaps contain locking tabs for preventing dislodgment of the brackets from the screws.

7 Claims, 6 Drawing Figures

Fig. 1
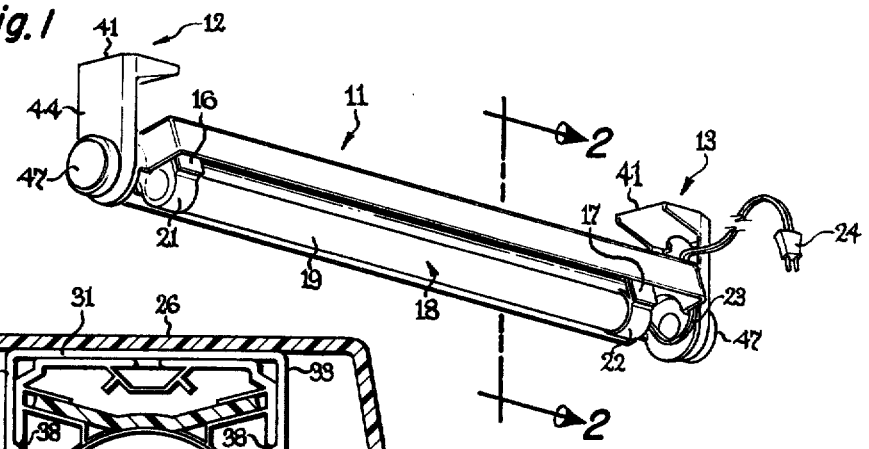
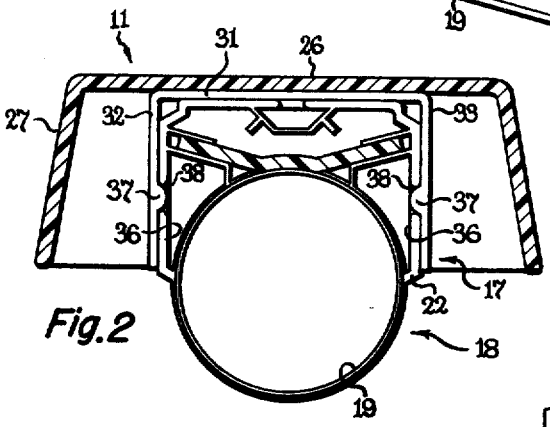
Fig. 2
Fig. 4
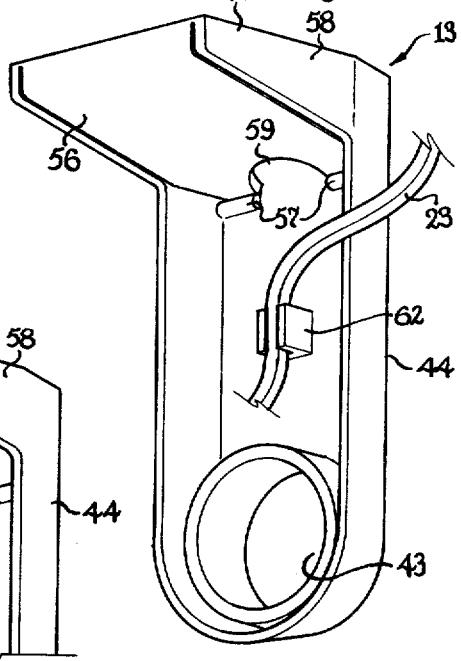
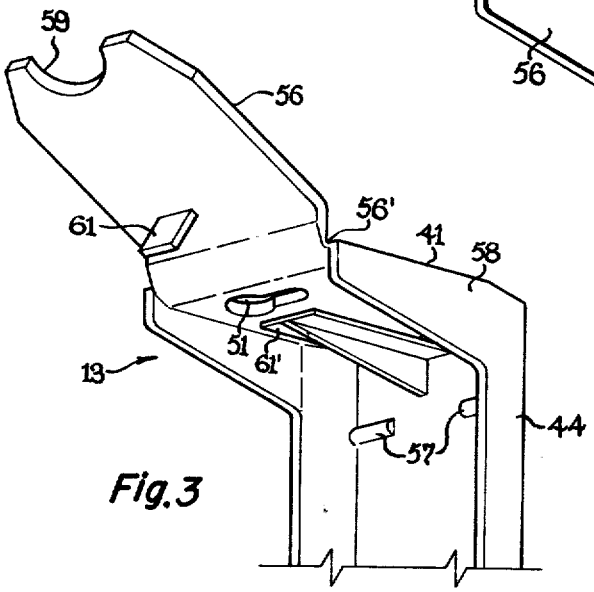
Fig. 3

Fig. 5
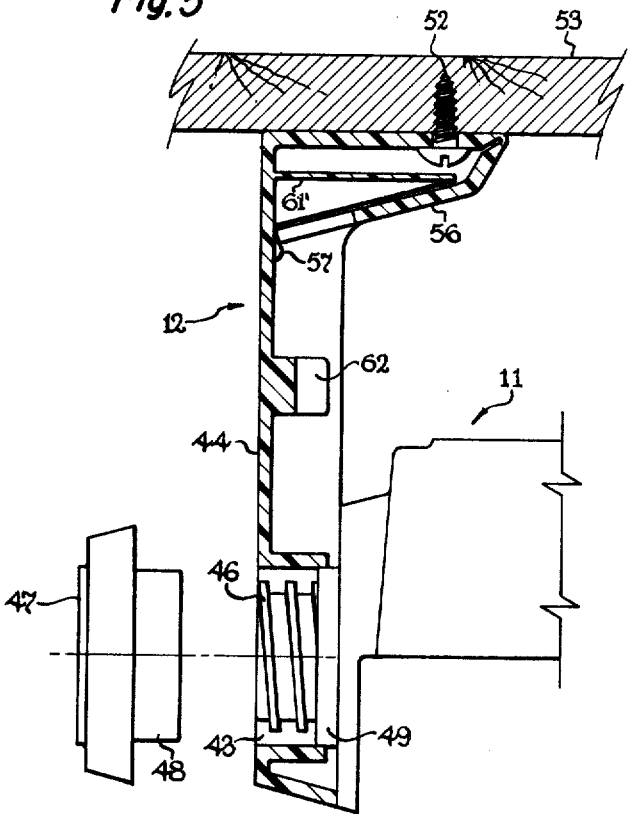
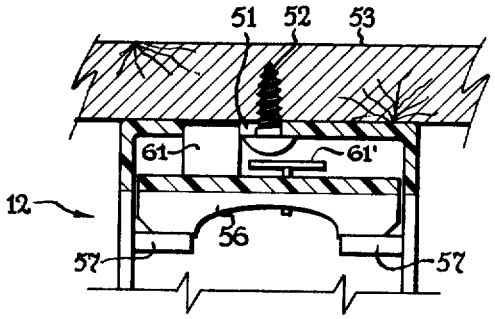
Fig. 6

MOUNTING MEANS FOR LAMP FIXTURE

CROSS-REFERENCE TO RELATED APPLICATION

Ser. No. 956,749, filed concurrently herewith, Joseph P. Wotowiec, "Fixture for Self-Contained Fluorescent Lamp Unit," assigned the same as this invention.

BACKGROUND OF THE INVENTION

The invention is in the field of fluorescent lamp fixtures.

Various fixtures have been devised for holding fluorescent lamp bulbs. Generally, they have been desk-type fixtures which are positioned on a desk surface, and hanging-type fixtures which are attached to or hang from a ceiling or screw into a socket. Also, self-contained fluorescent lamp units have been devised, which do not require separate fixtures for holding them. For example, U.S. Pat. No. 4,092,562 to Campbell discloses a self-contained fluorescent lamp unit including a resistor ballast and having end caps at the ends of a fluorescent bulb, these end caps being provided with openings for mounting the lamp unit to a surface by means of screws or the like. A plug-in cord extends from one of the end caps. U.S. Pat. Nos. 3,974,418 to Fridrich and 3,996,493 to Davenport and Fridrich disclose other types of constructions for self-contained fluorescent lamp units.

SUMMARY OF THE INVENTION

A principal object of the invention is to provide an improved mounting means for a fluorescent lamp fixture.

The invention comprises, briefly and in a preferred embodiment, a fluorescent lamp fixture having mounting brackets provided with keyhole-shaped openings for accommodating mounting screws. The mounting brackets have cover flaps for concealing the screws, and the cover flaps contain locking tabs positioned to prevent dislodgment of the brackets from the screws. Shelves are provided on the brackets to prevent a person from tightening the mounting screws.

BRIEF DESCRIPTION OF THE DRAWING

FIG. 1 is a perspective view of a lamp fixture in accordance with a preferred embodiment of the invention, shown holding a self-contained fluorescent lamp unit, and viewed from below as though it were mounted beneath a kitchen cabinet.

FIG. 2 is a cross-sectional view taken on the line 2—2 of FIG. 1.

FIG. 3 is a perspective view of a portion of a mounting bracket of the lamp fixture, shown with a cover flap in open position.

FIG. 4 is a perspective view of the mounting bracket shown with the cover flap in closed position.

FIG. 5 is a cross-sectional side view of a mounting bracket and associated parts.

FIG. 6 is a cross-sectional end view of a portion of the mounting bracket.

DESCRIPTION OF A PREFERRED EMBODIMENT

Referring to FIG. 1, the lamp fixture comprises an elongated shade 11 rotatably attached at the ends thereof to a pair of mounting brackets 12 and 13. The cross-sectional configuration of the shade 11 is concave, as shown in FIG. 2, and is provided within the concavity thereof a pair of resilient clips 16 and 17 adapted to hold a self-contained fluorescent lamp unit, such as the "Bright Stik" type, in fixed position with respect to the shade 11. The self-contained lamp unit 18 may be of a type as disclosed in the above-referenced patents, comprising an elongated fluorescent bulb 19 and end caps 21 and 22 of plastic material secured respectively to the ends of the bulb 19. An electrical power cord 23 extends from one of the end caps 22 and is provided with an electrical connector plug 22 at the end thereof. The lamp unit 18 contains a built-in ballast means for limiting the current in the lamp tube 18. This ballast means may be a resistor as disclosed in the above-referenced patents.

The lamp shade 11 may be shaped in various concave configurations, and may have a flat top 26 and sloping sides 27 and 28, as shown in the drawing. The lamp unit holding clips 16 and 17 may be made of resilient plastic shaped to have a flat upper region 31 and mutually parallel side regions 32 and 33. As shown in FIG. 2, the upper portion of the clips are adhered to the underside of the top 26 of the shade, such as by integral molding, adhesive, or otherwise, so that the legs 32 and 33 extend downwardly from the top 26 of the shade. The clip legs 32 and 33 are spaced apart so as to snugly receive mutually parallel side wall portions 36 of each of the end caps 21 and 22, and are provided with protrusions 37 which engage into openings 38 in the side walls 36 of the end caps when the lamp unit is inserted into position in the lamp fixture, thereby securely but removably holding the lamp unit 18 in position in the fixture, as shown in FIG. 2. The concave shade 11 may be dimensioned so that the lamp unit 18 is partly within the concavity thereof, as shown in FIGS. 1 and 2 or so that the lamp unit is entirely contained within the shade. In a modification, the side portions 27 and 28 of the shade may be shortened or eliminated, whereupon primarily the top portion 26 functions as a shade and may be tilted to provide the desired shading effect as will be described.

The mounting brackets 12 and 13, in accordance with the invention, shown in detail in FIGS. 3 through 6, are identical in the preferred embodiment and are made of molded plastic. Each of the mounting brackets 12 and 13 is provided with a mounting arm 41 having a flat mounting surface thereon, and also is provided with a circular opening extending laterally through the leg 44 of the bracket near the opposite end from the mounting surface 41. Each end of the tiltable shade 11 is provided with a circular threaded extension 46 adapted to fit within the openings 43, respectively, of the mounting brackets. Internally threaded end caps 47 screw on to the threaded extensions 46 and are provided with shoulders 48 which fit somewhat snugly and rotatably within the mounting bracket openings 43. The threaded extensions 46 may also be provided with circular shoulders 49 which fit somewhat snugly and rotatably in the bracket openings 43. The parts are dimensioned so that the end caps 47 can be tightened against the surface of the mounting brackets, to hold the brackets in a desired position with respect to the shade 11. When mounting the lamp fixture, the mounting brackets 12 and 13 are aligned with respect to each other so that their mounting surfaces 41 lie in a common plane.

In accordance with the invention, a keyhole-shaped opening 51 is provided through each of the mounting brackets at the mounting surface 41, the larger round portion of the keyhole-shaped opening being of adequate size to fit over the head of a mounting screw 52, and the slot portion of this opening being too narrow to fit over the head of the mounting screw 52. Instructions and/or a template are provided for indicating the correct positions for the two mounting screws to be screwed into a surface to which the fixture is to be mounted such as the underside of a kitchen cabinet. The mounting screws 52 are driven to a specified depth, such as by using a quarter coin as a spacer between the screw head and the surface of the mounting area. The lamp fixture is then positioned with the large circular part of the keyhole openings 51 fitted over the head of the mounting screws 52, and then is slid sideways so that the screw shank is in the narrow slot part of the keyhole opening 51, whereupon the screws 52 hold the fixture in position.

Further in accordance with the invention, a hinged flap cover 56 is provided at the end of the mounting portion 41 of each mounting bracket, and preferably is molded integrally with the bracket with a narrowed cross-section line 56' which functions as the hinge. The just-described steps of mounting the lamp fixture are performed with the cover 56 in open position as shown in FIG. 3. The hinged cover 56 is then swung into closed position, as shown in FIG. 4, and is held in closed position by ribs 57 on the inside surface of the bracket leg 44. The cover flap 56, when in closed position as shown in FIG. 4, fits inside a pair of side members 58 and thus conceals the mounting screw and other parts of the bracket. A finger recess 59 is provided at the free end of the flap cover 56, to permit it to be opened if desired by putting one's finger on other object in the recess 59 and pulling the cover 56 into open position.

A locking tab 61, as a feature of the invention, is provided on the inner surface of each hinged cover 56, and is positioned and dimensioned so that when the cover 56 is in closed position the locking tab 61 is positioned adjacent to the respective mounting screw 52 thus preventing the mounting bracket from sliding sideways and becoming detached from the mounting surface via the screw heads passing through the large circular part of the keyhole opening 51. The locking tabs 61 may extend into the large circular portions of the keyhole openings 51, if desired, as shown in FIG. 6. A shelf 61' is provided on each of the mounting brackets 12 and 13, and may be molded integrally with the brackets. The shelves 61' extend over the heads of the mounting screws 52, to prevent one from tightening these screws after the mounting brackets have been placed in final mounted position. If the screws were thus tightened, the installation would fall in the category of "permanent installation" for Underwriter's Laboratory approval, which is a different classification than the "portable" fixture disclosed. A "permanent installation" would not permit the plug-in line cord 23, and would require direct wiring to an adjacent outlet box.

The self-contained fluorescent lamp unit 18 can be attached to the shade 11 by positioning it in the mounting clips 16 and 17, either before or after the fixture is mounted. An electrical cord clip 62 is molded integrally with the mounting brackets 12 and 13, so that after the self-contained lamp unit is installed in the fixture, the electrical cord 23 can be placed in and held by the clip 62, for a neat appearance. The threaded end caps 47 can be unscrewed slightly, and the shade 11 and attached lamp unit 18 can be rotated or tilted to a desired angle so that the lamp will illuminate in a desired direction while at the same time the shade 11 will shade its light from person's eyes.

The invention achieves the desired objectives, and provides the advantages of easy and secure mounting, concealed mounting screws, pleasing appearance, and meeting Underwriter's Laboratory specifications for portable light fixtures.

While a preferred embodiment of the invention has been shown and described, various other embodiments and modifications thereof will become apparent to persons skilled in the art, and will fall within the scope of the invention as defined in the following claims.

What I claim as new and desire to secure by United States Letters Patent is:

1. A fluorescent lamp fixture having mounting means comprising at least one mounting bracket having a mounting portion adapted to be mounted against a mounting surface, a keyhole-shaped opening through said mounting portion for fitting over a mounting screw or the like, said keyhole-shaped opening comprising a combination of a receiving opening for receiving the head of said mounting screw or the like and a slot for receiving the shank of said mounting screw or the like, said mounting bracket further comprising a cover hinged thereto and adapted to cover and conceal said mounting screw or the like, said cover being provided with a locking means which prevents dislodgment of said mounting bracket from said mounting screw or the like.

2. A lamp fixture as claimed in claim 1 in which said cover is integral with said mounting bracket.

3. A lamp fixture as claimed in claim 1, in which said mounting bracket is provided with one or more ribs for holding said cover in closed position.

4. A lamp fixture as claimed in claim 1, in which said cover is provided with an opening away from its hinged end to facilitate unfastening the cover.

5. A lamp fixture as claimed in claim 1, in which said locking means comprises a tab extending from said cover toward said receiving opening and at a side of said mounting screw or the like when said cover is in closed position.

6. A lamp fixture as claimed in claim 5, in which said tab extends into said receiving opening when said cover is in closed position.

7. A lamp fixture as claimed in claim 1, in which said mounting bracket includes a shelf fixedly positioned over said slot part of the keyhole opening to prevent people from tightening the mounting screw or the like after the lamp fixture has been mounted.

* * * * *